US008025319B2

(12) United States Patent
Graute

(10) Patent No.: US 8,025,319 B2
(45) Date of Patent: Sep. 27, 2011

(54) MOTOR VEHICLE DOOR LOCK

(75) Inventor: Ludger Graute, Essen (DE)

(73) Assignee: Kiekert AG, Heiligenhaus (DE)

( * ) Notice: Subject to any disclaimer, the term of this patent is extended or adjusted under 35 U.S.C. 154(b) by 1155 days.

(21) Appl. No.: 10/555,199

(22) PCT Filed: Apr. 30, 2004

(86) PCT No.: PCT/DE2004/000920
§ 371 (c)(1),
(2), (4) Date: Nov. 1, 2005

(87) PCT Pub. No.: WO2004/101931
PCT Pub. Date: Nov. 25, 2004

(65) Prior Publication Data

US 2006/0055178 A1 Mar. 16, 2006

(30) Foreign Application Priority Data

May 8, 2003 (DE) ..... 103 20 442

(51) Int. Cl.
*E05C 3/06* (2006.01)

(52) U.S. Cl. ..... 292/216; 292/201; 292/DIG. 23

(58) Field of Classification Search ..... 292/201, 292/216, DIG. 23
See application file for complete search history.

(56) References Cited

U.S. PATENT DOCUMENTS

| | | | | |
|---|---|---|---|---|
| 6,305,727 | B1 * | 10/2001 | Bland | 292/216 |
| 2001/0048227 | A1 * | 12/2001 | Kachouh | 292/216 |
| 2003/0222463 | A1 * | 12/2003 | Mejean et al. | 292/216 |
| 2004/0004357 | A1 * | 1/2004 | Arlt et al. | 292/201 |
| 2006/0131893 | A1 * | 6/2006 | Tomaszewski | 292/216 |

FOREIGN PATENT DOCUMENTS

| | | |
|---|---|---|
| DE | 297 14 953 U 1 | 11/1997 |
| DE | 297 16 022 U 1 | 11/1997 |

* cited by examiner

*Primary Examiner* — Kristina Fulton
(74) *Attorney, Agent, or Firm* — Matthias Scholl, PC; Matthias Scholl

(57) ABSTRACT

The object of the present invention is a vehicle door latch with a locking mechanism (1, 2) comprising mainly a catch (1) and pawl (2). In addition, the vehicle door latch contains at least one sensor (4) for detecting the position of the catch (1). The invention provides an intermediate element (5) that transfers the movements of the catch (1) onto the sensor (4).

27 Claims, 3 Drawing Sheets

MOTOR VEHICLE DOOR LOCK

CROSS-REFERENCE TO RELATED APPLICATIONS

This is a National Stage Application of International Patent Application No. PCT/DE 2004/000920, with an international filing date of Apr. 30, 2004, which is based on German Patent Application No. 103 20 442.3, filed May 8, 2003. The contents of both of these specifications are incorporated herein by reference.

BACKGROUND OF THE INVENTION

1. Field of the Invention

The invention refers to a vehicle door latch containing a locking mechanism comprising mainly a catch and a pawl and with at least one sensor for detecting the catch.

2. Description of Related Art

The catch detection mainly serves to safely detect the first or primary position of the catch, in order to carry out, for instance, locking measures and/or to initiate an electrical opening after locking. For this purpose, switches or micro switches of prior art described in DE 297 14 953 U1 are in most cases suggested, which directly detect a profile on the catch. This method has, in general, been successfully used. We also refer to EP 1 069 266 A1.

As part of DE Patent Application 102 40 003, which only has to be considered according to §3 (2) PatG, a vehicle door latch is suggested that contains a blocking lever controlled via the catch. The blocking lever is arranged on the same axis as the catch and follows its motions of rotation. For this purpose, the blocking lever and the catch are connected to each other. The blocking lever is a two-armed lever, comprising a blocking arm and a detection arm, with the latter containing a sensor cooperating with a detection device, in order to be able to detect the position of the catch.

In the first described solutions, problems can occur when the catch is soiled, iced over, etc., allowing the micro switch to be potentially damaged. For this reason, non-contact sensors, such as Hall sensors, were used in the past, as described in DE Patent Application 102 40 003. Such sensors are, however, relatively expensive to produce and install. It also suffices in most cases to correctly detect a single position of the catch, the primary position. This can be reliably done with little effort by a mechanical switch.

Apart from these problems, the sensor must be located in the catch's immediate vicinity to detect it. Consequently, individual sensors can only be combined with difficulty in a vehicle door latch. The installation position for the sensor has, in any case, been determined. The invention aims to resolve these problems.

BRIEF DESCRIPTION OF THE DRAWINGS

Below, the invention is explained in more detail with reference to a drawing showing only one embodiment of the invention, in which.

BRIEF SUMMARY OF THE INVENTION

Figure 1:
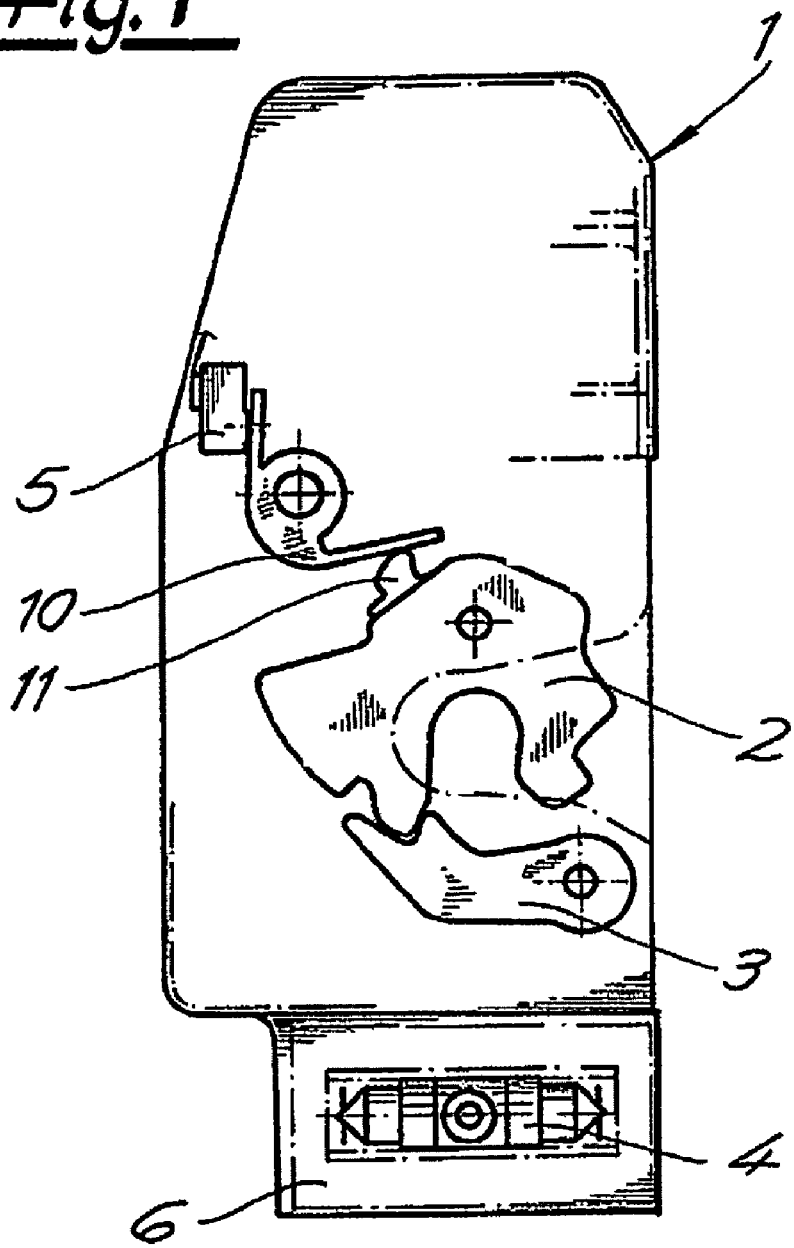
FIGS. 1 and 2 show different views of the vehicle door latch of the invention.

The invention described herein provides a vehicle door latch, with a locking mechanism (1, 2) comprising mainly a catch (1) and pawl (2) and with at least one sensor (4) for detecting the catch, with a intermediate element (5), rotatably fixed around an axis (6), positioned against the catch (1), said intermediate element transferring the movement of a catch (1) rotatably fixed around an axis (7) onto the sensor (4), characterized in that the axis (6) of the intermediate lever (5) and the axis (7) of the catch (1) are mainly arranged at right-angles to each other.

In certain embodiments of the invention described herein, the intermediate element (5) is pretensioned by, for instance, a spring in direction of the catch (1).

In certain embodiments of the invention described herein, the intermediate element (5) contains at least one detection profile (10) for the sensor (4).

In certain embodiments of the invention described herein, the intermediate element (5) contains an extension arm (9) that can be activated from the catch (1).

In certain embodiments of the invention described herein, the catch (1) contains a projection (8), interacting with the extension arm (9) on the intermediate element (5).

In certain embodiments of the invention described herein, the projection (8) on the catch (1) only impinges the extension arm (9) of the intermediate element (5) within a specified pivoting angle of the catch (1).

In certain embodiments of the invention described herein, the intermediate element (5) is seated on an insert (13) for a back plate (12).

In certain embodiments of the invention described herein, the intermediate element (5) contains a seat for a non-slam lock (17) that mechanically blocks a locking lever (18) if the catch (1) is open.

DETAILED DESCRIPTION OF THE INVENTION

The invention is based on the technical problem of further developing a vehicle door latch of the above nature in such a way that allows the correct detection of the catch position whilst taking into consideration a particular cost-effective and universally useable design of the sensor.

In order to solve this technical problem, a vehicle door latch of this type is characterized by containing an intermediate element, positioned against the catch, transferring the movements of the catch onto the sensor. —The catch and the intermediate element thus represent separate components, with the intermediate element being positioned against the catch, to transfer its movements onto the sensor. This system can, for instance, be contrived by the intermediate element being pre-tensioned in the direction of the catch by, e.g. means of a spring.

The intermediate element thus ensures that the sensor is uncoupled from the motions of rotation of the catch, so that a low-cost switch or micro switch can be used as a sensor. Soiling and/or damage of the catch thus no longer have an effect, as such impairments are not transferred to the sensor by the intermediate element located in between the two components. This also applies if the catch is iced over, as the intermediate element is generally protected inside a latch housings or back plate.

The intermediate element is, in most cases, an intermediate lever, rotatable around an axis. Said intermediate lever or detection lever has a mainly circular to oval shape, with the axis of the intermediate lever and one axis of the catch being mainly arranged at right angles to each other. It is therefore possible to position the sensor outside of the catch plane, for examples on a leg of the latch housing or back plate. The position of the sensor can thus be more or less randomly determined. This allows the option of combining and integrating the sensor, where applicable, with further sensors as well as electrical equipment and/or an already existing printed circuit board.

In order to be able to correctly trigger the sensor, the intermediate element has at least one detection profile for the sensor. Usually, a switch or micro switch is used as sensor. In order to trigger the intermediate element, it contains an extension arm actuatable by the catch with the extension arm generally interacting with a projection on the catch.

As the axis of the intermediate lever and the axis of the catch are mainly arranged at right-angles to each other, the projection on the catch only acts upon the extension arm of the intermediate element or intermediate lever within a predefined pivoting angles of the catch. According to the described right-angle arrangement, both said elements, e.g. catch and intermediate element or intermediate lever, complete one rotation at right angles to each other. Because of this topology, an overlap between the projection on the catch and the extension arm of the intermediate element or intermediate lever is produced within a certain pivoting angle of the catch. This will be explained in more detail with reference to the description of the figures.

In order to facilitate fixing of the intermediate element, it is fixed to an insert for the latch housing or the back plate. In general, the insert has the required hole for accommodating an axle for the intermediate element or the intermediate lever. The insert may be an intake insert, i.e. an insert that usually defines the inlet opening. In this way, no costly storage measures are required for the intermediate element on the latch housing or back plate. Instead, insert and intermediate element can constitute a prefabricated subassembly.

Finally, there is the option of the intermediate element being able to accommodate a non-slam lock. This means that the non-slam lock can be coupled with the intermediate element. The non-slam lock ensures that one or more locking levers are mechanically blocked when the catch is open. In other words, the intermediate element will take on a dual function in this context. On one hand it will ensure that the sensor and switch or micro switch correctly reproduces the position of the catch. On the other hand, the intermediate element ensures via the connected non-slam lock that, whilst the catch is open, the locking lever or a complete locking lever mechanism is mechanically blocked.

As a result, drivers can no longer lock themselves out, e.g. by a car door being unintentionally closed and locked, whilst the car key is still inside the car. In other words, the intermediate element or the intermediate lever together with the non-slam lock ensure that the respective vehicle door latch and the several vehicle door latches are unable to assume their locked position, because the respective locking lever or the entire locking lever mechanism are mechanically blocked by the non-slam lock whilst the catch is open.

Consequently, a vehicle door latch is provided that, with the aid of the intermediate element, removes any potential adverse effects of the catch on the sensor. Also, the intermediate element or the intermediate lever offers the option of placing the sensor in nearly any position without the movement and arrangement of the catch having to be taken into consideration. These are the main advantages.

The figures show a vehicle door latch whose fundamental design includes a locking mechanism 1, 2 consisting of a catch 1 and pawl 2. The locking mechanism 1, 2 interacts with a locking pin 3, only indicated in FIG. 1, in the usual manner. In order to be able to detect the position of the catch 1, a sensor 4 is provided, which in case of the embodiment is a micro switch 4.

According to the invention, an intermediate element 5, transmitting the movements of the catch 1 on sensor 4 is arranged between the sensor or micro switch 4 and the catch 1 to be detected. In the embodiment, the intermediate element 5 is an intermediate lever 5 with a mainly circular or oval overall shape. In general, naturally any intermediate elements 5 that are able to transfer the motions of rotation of the catch 1 onto the sensor or micro switch 4, can be used. It is, for instance possible to use adjusting rods, gears, frictional wheels, Bowden cables, etc. The intermediate lever 5, shown in the embodiment, requires, however, the least design effort.

The intermediate element or the intermediate lever 5 is rotatably arranged around an axis 6. The catch 1 contains, in contrast, an axis 7 mainly arranged vertically. As a result of the angled arrangement of the two axes 6,7, the intermediate element or the intermediate lever 5 is only caught by the catch 1 within a limited angle of rotation, in order to activate the sensor or micro switch 4. In general, the described catching only occurs when the catch 1 leaves the primary position shown in FIGS. 1 and 2. For this purpose, the pawl 2 may be lifted (mechanically or by motor) so that the catch 1 carries out a clockwise rotation indicated by an arrow in FIG. 2.

This causes a projection 8 on the catch 1 to engage in a extension arm 9 on the intermediate element or intermediate lever 5, so that catch 1, turning clockwise, moves the intermediate lever 5 in the indicated anti-clockwise direction when viewed from the front. Consequently, a detection profile 10 on the intermediate lever 5 for sensor 4 is able to produce a signal on the output side of the sensor 4. A control system—not shown—is consequently informed that the catch 1 has left its primary position and carries out an opening movement.

Starting from the open position of the catch 1, closing movements of the catch 1 result in clockwise rotations of the intermediate levers 5, viewed from the front, as a result of a relative movement between an inlet opening 11 and a locking pin 3. The locking pin 3 in the reference system of the vehicle door latch actually moves into the respective inlet opening 11. If, however, the vehicle body with the attached locking pin constitutes the reference system, the vehicle door latch with its inlet opening 11 moves in relation to said system.

In any way, the sensor or micro switch 4 is not triggered during this process. Generally one could also detect this movement or the catch 1 reaching the primary position. This is, however, not shown. The primary aim, is after all, to detect the opening movement of the catch 1.

Because of the used intermediate element or intermediate lever 5, the sensor or micro switch 4 can be arranged at practically any position within a latch housing or back plate 12. In the present case, a positioning along an L-leg of the back plate or latch housing 12 has proven to be advantageous. Catch 1 does thus (no longer) determine the position of the sensor 4.

Figure 3:
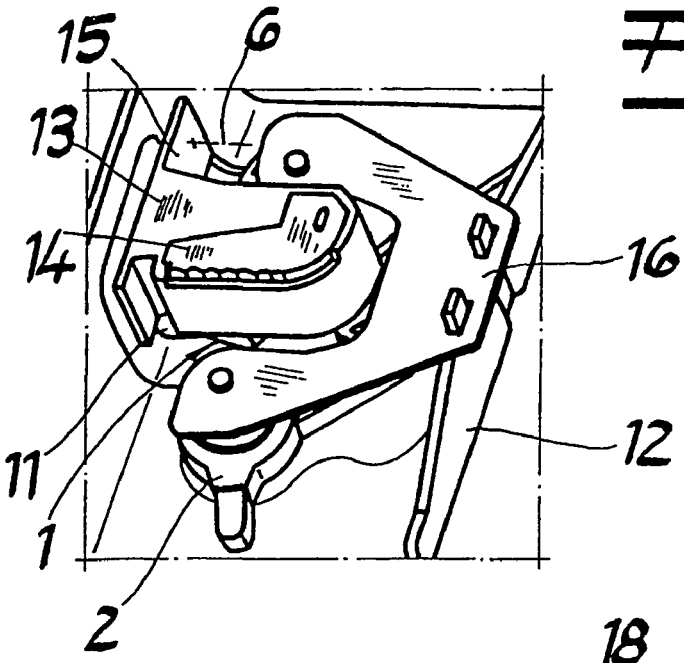
FIG. 3 shows the vehicle door latch of FIGS. 1 and 2 with the insert arranged in the latch housing for holding the intermediate element.

In the embodiment, the intermediate element or the intermediate lever 5 is advantageously seated at an insert 13 for the latch housing or the back plate 12. This is, in particular, demonstrated in FIG. 3, where this insert 13 is shown. The insert 13 is an inlet insert 13, i.e. an insert that defines the inlet opening 11 for the locking pin 3. The insert or inlet insert 13 is a molded plastic part with an integrated damping element 14 for locking pin 3 and the catch 1.

This insert or inlet insert 13 contains a fixing plate 15 with an elongation, accommodating a journal as axis 6 onto which, in turn, the intermediate lever 5 is positioned. Consequently, insert 13 and intermediate lever 5 form a sub-assembly, that can be connected in its entirety to the latch housing or back plate 12, for instance by latching, riveting, screwing, gluing, etc. The intermediate element or the intermediate lever 5 can also be a molded plastic part. An additional reinforcement plate 16, shown in FIG. 3, also ensures the correct fixing of the catch 1.

Figure 4:
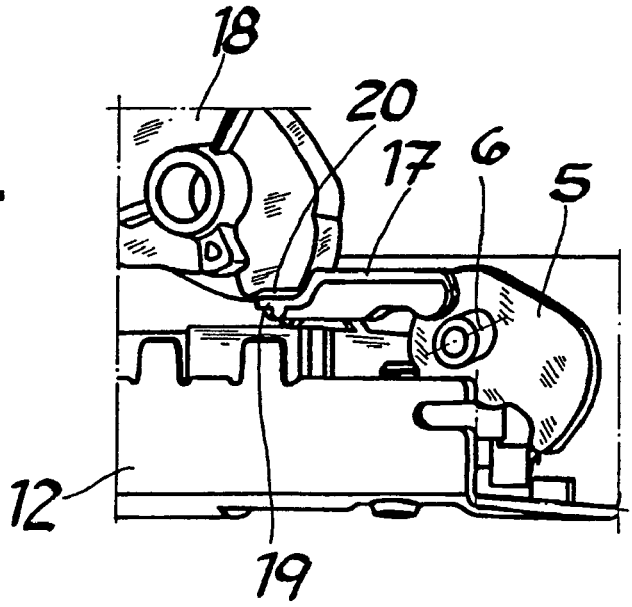
FIGS. 4 and 5 show the non-slam lock on the intermediate element whilst the catch is open (FIG. 4) and closed (FIG. 5).
Figure 5:
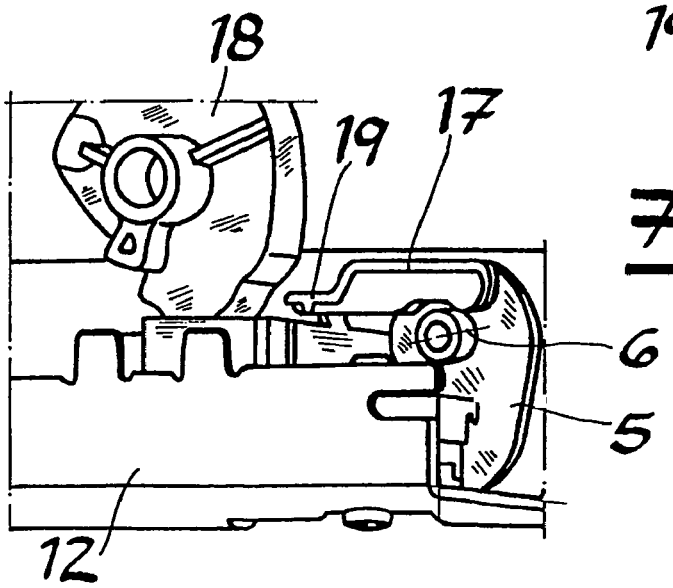
Figure 1:
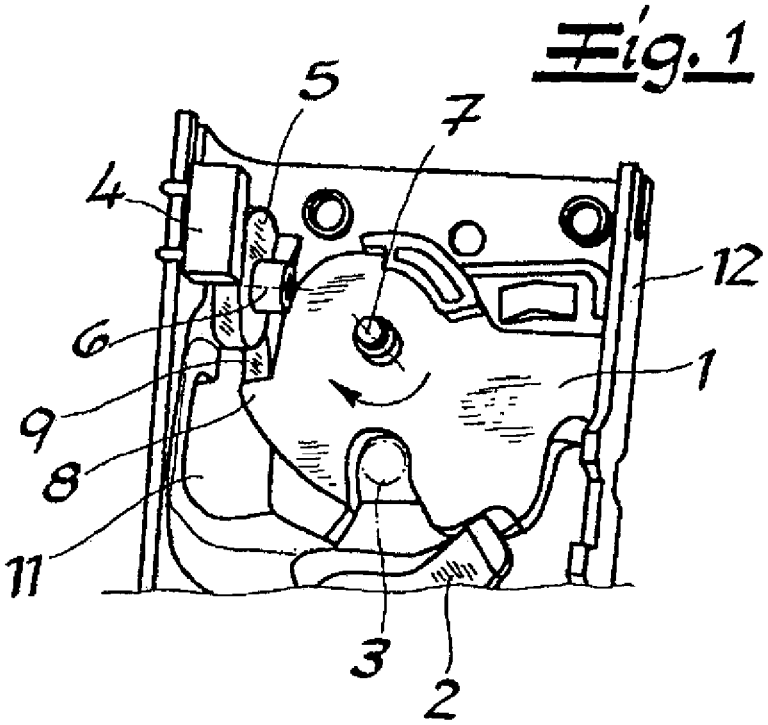
Figure 2:
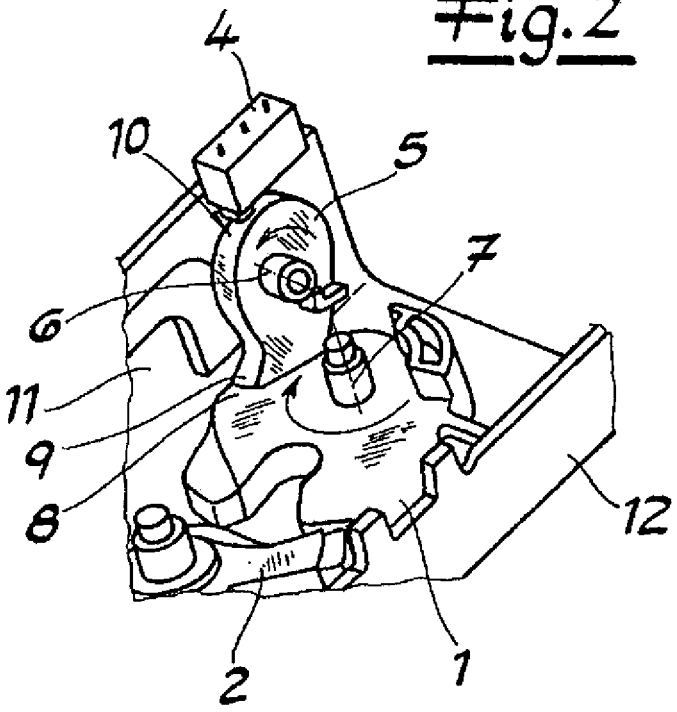

FIGS. 4 and 5 show the further function of the intermediate element 5. It not only transmits the motions of rotation of the catch 1 to the sensor 4 but also provides a seat for a non-slam lock 17. When catch 1 is open, this non-slam lock 17 mechanically blocks (see FIG. 4) a locking lever 18. For this purpose, the non-slam lock 17, designed as a pushing lever 17, engages with a front projection 19 into a recess 20 of the locking levers 18.

If the catch 1 is, however, in its closed position, the non-slam lock or the pushing lever 17 is retracted by the intermediate lever 5, so that the projection 19 leaves the recess 20. The locking lever 18 is then free.

The pushing lever 17 can be connected to the intermediate lever 5 by clipping, bolting, riveting or welding. This also applies for all connections between individual levers, with the respective rotation movement having to be ensured, where required.

What is claimed is:

1. A vehicle door latch with a locking mechanism (1, 2) comprising a catch (1) having a first axis of rotation (7);

a pawl (2);

at least one sensor (4) for detecting the position of said catch (1); and an intermediate element (5) having a second axis of rotation (6);

wherein said intermediate element (5) transfers a movement of said catch (1) around said first axis of rotation (7) onto said sensor (4); and said first axis of rotation (7) and said second axis of rotation (6) are not parallel in space with respect to each other.

2. The vehicle door latch of claim 1, wherein said first axis of rotation (7) and said second axis of rotation (6) are orthogonal in space with respect to each other.

3. The vehicle door latch of claim 1, wherein said intermediate element (5) is pre-tensioned with respect to said catch (1).

4. The vehicle door latch of claim 1, wherein said intermediate element (5) comprises at least one detection profile (10) for interacting with at least one said sensor (4).

5. The vehicle door latch of claim 1, wherein said intermediate element (5) comprises an extension arm (9), said extension arm (9) mechanically interacting with said catch (1).

6. The vehicle door latch of claim 1, wherein said catch (1) comprises a projection (8), said projection (8) being mechanically interacting with said intermediate element (5).

7. The vehicle door latch of claim 1, wherein said catch (1) comprises a projection (8); and said intermediate element (5) comprises an extension arm (9); said extension arm (9) mechanically interacting with said projection (8).

8. The vehicle door latch of claim 6, wherein said projection (8) activates said intermediate element (5) within a limited pivoting angle of said catch (1) only.

9. The vehicle door latch of claim 6, wherein said projection (8) activates said intermediate element (5) when said catch (1) leaves its primary position.

10. The vehicle door latch of claim 1, comprising further a latch housing (12) and an inlet insert (13) for said latch housing (12), wherein said intermediate element (5) is seated on said inlet insert (13) for said latch housing (12).

11. The vehicle door latch of claim 1, wherein said intermediate element (5) supports a non-slam lock (17), said non-slam lock (17) mechanically blocking a locking lever (18) when said catch (1) is open.

12. The vehicle door latch of claim 1, wherein said intermediate element (5) is coupled with a non-slam lock (17), said non-slam lock blocking a door latch locking lever (18) when said catch (1) is open.

13. The vehicle door latch of claim 9, wherein said intermediate element (5) is coupled with a non-slam lock (17), said non-slam lock blocking a door latch locking lever (18) when said catch (1) is open.

14. The vehicle door latch of claim 1, wherein said intermediate element (5) is coupled with a non-slam lock (17), said non-slam lock not blocking a door latch locking lever (18) when said catch (1) is closed.

15. The vehicle door latch of claim 9, wherein said intermediate element (5) is coupled with a non-slam lock (17), said non-slam lock not blocking a door latch locking lever (18) when said catch (1) is closed.

16. The vehicle door latch of claim 9, wherein said intermediate element (5) and said inlet insert (13) taken together constitute a prefabricated assembly.

17. The vehicle door latch of claim 10, wherein said assembly is attached to said latch housing (12) via one of the following: latching, riveting, screwing, or gluing.

18. The vehicle door latch of claim 1, wherein said intermediate element (5) is made of molded plastic.

19. The vehicle door latch of claim 6, wherein said projection (8) activates said intermediate element (5) during the opening movement of said catch (1) only.

20. The vehicle door latch of claim 1, wherein at least one said sensor (4) is a switch.

21. The vehicle door latch of claim 20, wherein at least one said sensor (4) is a micro switch.

22. The vehicle door latch of claim 1, wherein at least one said sensor (4) is able to detect a position of said catch (1) if said catch (1) is damaged;

said catch (1) is soiled; or said catch (1) is iced-over.

23. The vehicle door latch of claim 1, wherein said intermediate element (5) has a circular or an oval shape.

24. The vehicle door latch of claim 1, wherein said intermediate element (5) is a frictional wheel.

25. A vehicle door latch with a locking mechanism (1, 2) comprising a catch (1) having a first axis of rotation (7);

a pawl (2);

at least one sensor (4) for detecting the position of said catch (1); and an intermediate element (5) having a second axis of rotation (6);

wherein said intermediate element (5) transfers a movement of said catch (1) around said first axis of rotation (7) directly onto said sensor (4); and said first axis of rotation (7) and said second axis of rotation (6) are not parallel in space with respect to each other.

26. A vehicle door latch with a locking mechanism (1, 2) comprising a catch (1) having a first axis of rotation (7);

a pawl (2);

at least one sensor (4) for detecting the position of said catch (1); and an intermediate element (5) having a second axis of rotation (6); wherein said intermediate element (5) transfers a movement of said catch (1) around said first axis of rotation (7) onto said sensor (4); and said intermediate element (5) is directly connected to said sensor (4); and said first axis of rotation (7) and said second axis of rotation (6) are not parallel in space with respect to each other.

27. The vehicle door latch of claim 1 further comprising a latch housing or a back plate (12), wherein said sensor (4) is disposed on said latch housing or on said back plate (12).

* * * * *

UNITED STATES PATENT AND TRADEMARK OFFICE

CERTIFICATE OF CORRECTION

PATENT NO. : 8,025,319 B2
APPLICATION NO. : 10/555199
DATED : September 27, 2011
INVENTOR(S) : Ludger Graute It is certified that error appears in the above-identified patent and that said Letters Patent is hereby corrected as shown below:

The title page showing the illustrative figure should be deleted and replaced with the attached title page.

Figure 2:
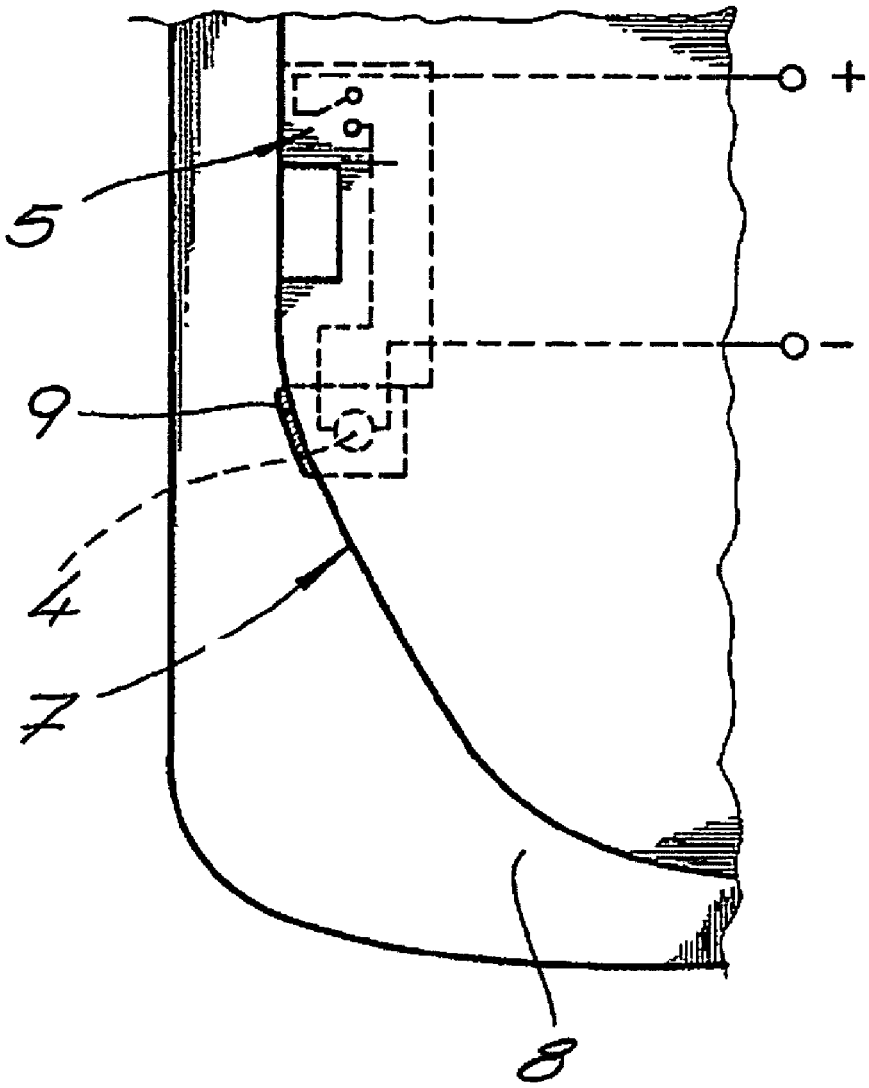

In the drawings, sheets 1 and 2 of 3, consisting of figures 1 and 2, should be deleted and replaced with the corrected figures 1 and 2, as shown on the attached pages.

IN THE CLAIMS:

In Column 6, Line 22, Claim 16, delete “of claim 9” and insert --of claim 10--, therefor.

In Column 6, Line 25, Claim 17, delete “of claim 10” and insert --of claim 16--, therefor.

Signed and Sealed this
Sixth Day of December, 2011

David J. Kappos

David J. Kappos
*Director of the United States Patent and Trademark Office*

(12) United States Patent
Graute

(10) Patent No.: US 8,025,319 B2
(45) Date of Patent: Sep. 27, 2011

(54) MOTOR VEHICLE DOOR LOCK

(75) Inventor: Ludger Graute, Essen (DE)

(73) Assignee: Kickert AG, Heiligenhaus (DE)

( * ) Notice: Subject to any disclaimer, the term of this patent is extended or adjusted under 35 U.S.C. 154(b) by 1155 days.

(21) Appl. No.: 10/555,199

(22) PCT Filed: Apr. 30, 2004

(86) PCT No.: PCT/DE2004/000920
§ 371 (c)(1),
(2), (4) Date: Nov. 1, 2005

(87) PCT Pub. No.: WO2004/101931
PCT Pub. Date: Nov. 25, 2004

(65) Prior Publication Data

US 2006/0055178 A1 Mar. 16, 2006

(30) Foreign Application Priority Data

May 8, 2003 (DE) ..... 103 20 442

(51) Int. Cl.
*E05C 3/06* (2006.01)

(52) U.S. Cl. ..... 292/216; 292/201; 292/DIG. 23

(58) Field of Classification Search ..... 292/201, 292/216, DIG. 23
See application file for complete search history.

(56) References Cited

U.S. PATENT DOCUMENTS

| | | | | |
|---|---|---|---|---|
| 6,305,727 | B1 * | 10/2001 | Bland | 292/216 |
| 2001/0048227 | A1 * | 12/2001 | Kachouh | 292/216 |
| 2003/0222463 | A1 * | 12/2003 | Mejean et al. | 292/216 |
| 2004/0004357 | A1 * | 1/2004 | Arlt et al. | 292/201 |
| 2006/0131893 | A1 * | 6/2006 | Tomaszewski | 292/216 |

FOREIGN PATENT DOCUMENTS

| | | |
|---|---|---|
| DE | 297 14 953 U 1 | 11/1997 |
| DE | 297 16 022 U 1 | 11/1997 |

* cited by examiner

*Primary Examiner* -- Kristina Fulton
(74) *Attorney, Agent, or Firm* -- Matthias Scholl, PC; Matthias Scholl

(57) ABSTRACT

The object of the present invention is a vehicle door latch with a locking mechanism (1, 2) comprising mainly a catch (1) and pawl (2). In addition, the vehicle door latch contains at least one sensor (4) for detecting the position of the catch (1). The invention provides an intermediate element (5) that transfers the movements of the catch (1) onto the sensor (4).

27 Claims, 3 Drawing Sheets

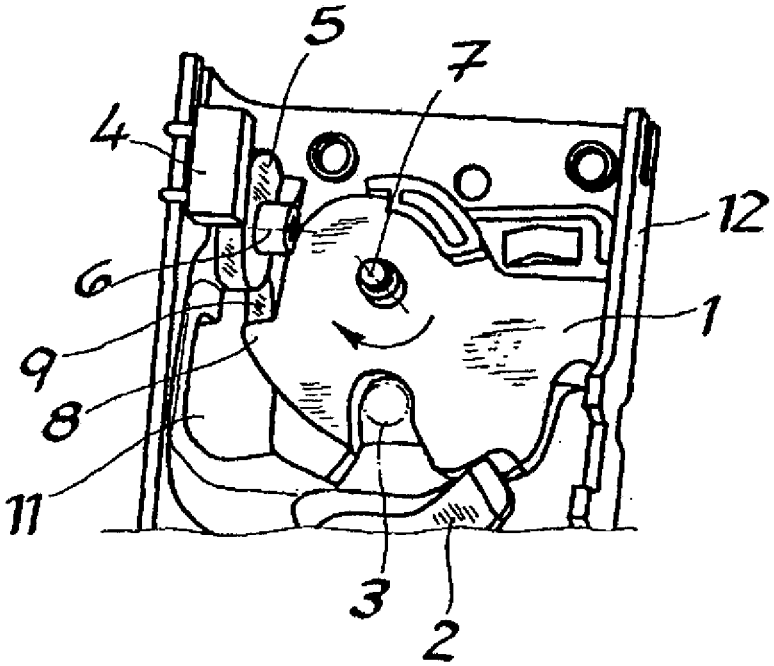

5
7
4
12
6
1
9
8
11
3
2